US006966476B2

(12) United States Patent
Jalbert et al.

(10) Patent No.: US 6,966,476 B2
(45) Date of Patent: Nov. 22, 2005

(54) INTEGRATED CHECK PAWL, LAST NAIL-RETAINING, AND DRY FIRE LOCK-OUT MECHANISM FOR FASTENER-DRIVING TOOL

(75) Inventors: David B Jalbert, Coventry, RI (US); Charles W Hewitt, Warwick, RI (US); Zheng Fang, Cranston, RI (US)

(73) Assignee: Stanley Fastening Systems, L.P., East Greenwich, RI (US)

( * ) Notice: Subject to any disclaimer, the term of this patent is extended or adjusted under 35 U.S.C. 154(b) by 0 days.

(21) Appl. No.: 10/629,912

(22) Filed: Jul. 30, 2003

(65) Prior Publication Data

US 2005/0023323 A1 Feb. 3, 2005

(51) Int. Cl.[7] ..... B27F 7/17
(52) U.S. Cl. ..... 227/8; 227/137
(58) Field of Search ..... 227/128, 129, 227/8, 138, 137, 119, 120

(56) References Cited

U.S. PATENT DOCUMENTS

| | | | | |
|---|---|---|---|---|
| 2,078,064 A | | 4/1937 | Day | |
| 3,330,462 A | | 7/1967 | Colechia et al. | |
| 3,543,987 A | | 12/1970 | Obergfell et al. | |
| 3,708,097 A | | 1/1973 | Fisher | |
| 3,858,780 A | | 1/1975 | Perkins et al. | |
| 4,319,705 A | | 3/1982 | Geist et al. | |
| 4,433,782 A | | 2/1984 | Figge et al. | |
| 4,442,965 A | | 4/1984 | Leistner | |
| 4,585,154 A | | 4/1986 | Fealey et al. | |
| 4,597,517 A | | 7/1986 | Wagdy | |
| 4,597,518 A | | 7/1986 | Paul | |
| 4,619,393 A | | 10/1986 | Maurer | |
| 4,712,676 A | | 12/1987 | Randall | |
| 4,716,813 A | | 1/1988 | Prudencio | |
| 4,729,164 A | | 3/1988 | Steeves | |
| 4,767,043 A | | 8/1988 | Canlas, Jr. | |
| 4,768,696 A | | 9/1988 | Sjogren | |
| 4,858,812 A | | 8/1989 | Fealey | |
| 4,932,580 A | | 6/1990 | Pfister et al. | |
| 4,942,996 A | | 7/1990 | Wolfberg et al. | |
| 5,083,694 A | | 1/1992 | Lemos | |
| 5,167,359 A | * | 12/1992 | Frommelt | 227/8 |
| 5,191,861 A | | 3/1993 | Kellerman et al. | |
| 5,231,750 A | | 8/1993 | Fealey | |
| 5,240,161 A | * | 8/1993 | Kaneko | 227/109 |
| 5,263,842 A | | 11/1993 | Fealey | |
| 5,267,682 A | | 12/1993 | Okouchi | |
| 5,297,713 A | | 3/1994 | Perra et al. | |
| 5,335,839 A | | 8/1994 | Fealey | |
| 5,363,999 A | | 11/1994 | Braun et al. | |
| 5,366,132 A | | 11/1994 | Simonelli | |
| 5,370,295 A | | 12/1994 | Simonelli | |
| 5,476,205 A | | 12/1995 | Canlas et al. | |

(Continued)

FOREIGN PATENT DOCUMENTS

JP 35413647 BA 10/1979

*Primary Examiner*—Rinaldi I. Rada
*Assistant Examiner*—Paul Durand
(74) *Attorney, Agent, or Firm*—Pillsbury Winthrop Shaw Pittman LLP

(57) ABSTRACT

A fastener-driving tool includes an integrated function member that performs at least two of the following three functions: a check pawl function, a last fastener-retaining function, and a dry fire lock-out function. In the disclosed embodiment, the integrated function member is provided as a lever-type structure that constitutes part of the access door assembly by means of which access is gained to the fastener drive track along which fasteners (e.g., roofing nails) are fed to the driving portion of the tool. Also disclosed is an improved method of retaining the last nail in the drive track by a lateral head gripping action and a tool for performing the method.

54 Claims, 13 Drawing Sheets

U.S. PATENT DOCUMENTS 5,480,088 A 1/1996 Braun et al.
5,551,620 A 9/1996 Vallee
5,551,621 A 9/1996 Vallee
5,568,753 A 10/1996 Habermehl et al.
5,628,444 A 5/1997 White
5,634,582 A 6/1997 Morrison, Jr. et al.
5,669,542 A 9/1997 White
5,683,024 A 11/1997 Eminger et al.
5,711,471 A 1/1998 White
D392,862 S 3/1998 Kaiser et al.
5,738,266 A * 4/1998 Ogawa ..... 227/128
5,772,098 A * 6/1998 Crutcher ..... 227/119
5,803,338 A * 9/1998 Singer et al. ..... 227/8
5,829,660 A 11/1998 White
5,850,961 A 12/1998 Braun et al.
5,931,366 A 8/1999 Muro
5,947,362 A 9/1999 Omli
6,024,268 A 2/2000 Horng-Lin
6,032,848 A 3/2000 Smolinski
6,065,660 A 5/2000 Cabrera
6,126,057 A 10/2000 Li
6,152,346 A 11/2000 Laubach
6,170,730 B1 1/2001 Lin
6,199,739 B1 * 3/2001 Mukoyama et al. ..... 227/8
6,209,770 B1 * 4/2001 Perra ..... 227/8
6,244,140 B1 6/2001 Habermehl
6,308,880 B1 10/2001 Ronconi
6,592,014 B2 * 7/2003 Smolinski ..... 227/8
6,609,646 B2 * 8/2003 Miller et al. ..... 227/8
2002/0017548 A1 2/2002 Jalbert et al.
2002/0100787 A1 8/2002 Lin
2002/0104868 A1 8/2002 Miller et al.
2003/0015565 A1 1/2003 Lee
2003/0111239 A1 6/2003 Smolinksi

* cited by examiner-

INTEGRATED CHECK PAWL, LAST NAIL-RETAINING, AND DRY FIRE LOCK-OUT MECHANISM FOR FASTENER-DRIVING TOOL

1. FIELD OF THE INVENTION

In general, the present invention relates to a fastener-driving tool such as, but not limited to, a pneumatic nail driver. More particularly, the invention relates to mechanism by means of which fasteners are fed to the fastener drive track and retained within the drive track, and by means of which dry firing of the tool is prevented.

2. BACKGROUND OF THE INVENTION

Roofing tools (e.g., pneumatic roofing tools) are used to drive roofing nails into workpieces such as shingles to secure the shingles to the underlying wood substructure. Such roofing tools typically have a magazine that holds a supply of nails. The nails are typically collated by being spot-welded or otherwise affixed at their shanks to a pair of flexible metal wires or by being embedded in or adhered to a plastic or paper collating strip. Existing nail magazines typically are configured to receive a supply of nails arranged in either a stick or a coil arrangement.

Because the nails in a stick-type magazine are arranged in a linear fashion, a spring-biased or otherwise tensioned feed mechanism can be used to urge the stick-shaped collation of nails into the fastener drive track located in the nose portion of the tool by pushing the stick of nails from the rear thereof. In a coil magazine arrangement, on the other hand, the nails are arranged in a spiral, with the nails being fed into the fastener-drive track from the leading succession of fasteners in the coil. Because the nails are arranged in a spiral or coil configuration, a spring-biased or otherwise tensioned pusher apparatus by means of which the supply of nails is urged toward the fastener-driving track from the tail end of the supply would not be suitable. Therefore, roofing tools with coil-type magazines typically have a reciprocating feed mechanism that is operatively disposed along the feed track between the magazine and the fastener-driving track. Upon actuation of the fastener-driving tool, the feed pawl of the reciprocating feed mechanism retracts and "catches" a following nail in the strip or collation of nails; upon its return stroke, the feed pawl pulls the succession of nails forward, toward the nose portion of the roofing tool to advance the nails and feed the leading nail successively into the drive track.

As the feed pawl reciprocates, there is a tendency for it to "carry" the nails away from the fastener-driving track as it retracts to grab a nail. Therefore, a check pawl typically is provided in the reciprocating feed mechanism to prevent the strip of nails from being pushed backward as the feed pawl retracts. The check pawl may, for example, be provided within the fastener feed track access door—the door by means of which access is gained into the nose portion of the tool, e.g., to load the nails into the nose portion of the tool at the beginning of a given supply—in generally opposing relationship to the feed pawl.

As the nails within a given strip of nails are used up and the supply diminishes, less nails remain within the fastener feed track to properly position and hold the nail that is about to be driven within the drive track. Therefore, various configurations have been developed to hold the last nail to be driven within the tool. For example, certain tools have used a small magnet on the side of the drive track to hold the last nail in position. However, such a device has not proven to be very effective and reliable during extensive field usage. In particular, it has been found that about half of the time, the last nail will not be held within the drive track and will simply drop on the roof. That is undesirable because the operator will have to clean up after the job, he may injure himself by stepping on the dropped nails, and/or it is wasteful of nails.

In addition to these drawbacks or disadvantages, some fastener-driving tools are known in which there is no effective mechanism to indicate to the operator that no fasteners (e.g., nails) remain in the tool. In that case, the operator can keep operating the tool without fasteners, which causes the tool driver tip to strike and dent the roofing shingle or other workpiece.

3. SUMMARY OF THE INVENTION

One aspect of the invention, while applicable to any power operated tool for driving headed nails from a collated supply, is particularly useful in solving the problems identified above relating to roofing tools. The tools contemplated herein operate so that the leading nail of the supply is fed along a feed track into a drive track by a power operated reciprocating mechanism so as to enable the leading nail on the drive track to be driven outwardly of the drive track into a workpiece by the power system of the tool. In this aspect of the invention, the reciprocating mechanism includes an integrated function member which has a check pawl portion and either a last-fastener-retaining portion or a dry fire lock out portion or both. The configuration of the check pawl portion of the integrated function member is such that during operation of the power operated tool when two or more headed nails remain in the supply to be driven, the check pawl portion of the integrated function member engages the succession of headed nails within the fastener feed track to limit the succession of headed roofing nails from moving as the reciprocating mechanism retracts while operating to advance the succession of headed nails toward the drive track. The integrated function of the last-fastener-retaining portion is such that when a last headed nail remains to be driven into the workpiece, the last-fastener retaining portion holds the headed nail within the drive track to prevent the last headed nail from falling out of the drive track without being driven into the workpiece. The integrated function of the dry fire lock out portion of the integrated function member is such that when no headed nails remain within the tool, the dry fire lockout portion prevents operation of the actuating mechanism for the power system of the tool to thereby prevent further fastener driving movement of the fastener driving member.

Another aspect of the present invention is not only applicable to power operated tools having reciprocating feed mechanisms for feeding successive headed nails into the drive track but is also applicable to other power operated tools having other known fastener feeding mechanism for feeding known fasteners other than headed nails into a drive track to be driven therefrom into a workpiece. In this aspect of the invention, the tool includes an integrated function member including a last fastener retaining portion and a dry fire lock-out portion, each of which provides the functions attributable to the respective portion as indicated above.

Still another aspect of the present invention relates to an improved method for retaining the last headed fastener within the fastener drive track of a fastener driving tool so as to prevent the last headed fastener from falling out of the drive track without being driven by the operation of the tool.

The method includes the step of engaging the head of the last fastener in the drive track along a periphery thereof with a first head engaging surface at a position disposed laterally with respect to the predetermined direction of movement of the last headed fastener into the drive track and applying a force on the head of the last fastener by the engagement of said first surface which causes the head of the last nail to be biased into engagement with a wall surface defining a portion of the drive track which is laterally opposite from the position of engagement of said first surface so that the head of the last nail is gripped between said two opposed surfaces.

Another aspect of the present invention relates to a headed fastener driving tool having opposed surfaces which function in a manner to perform the above described method.

4. BRIEF DESCRIPTION OF THE DRAWINGS

The invention will now be described in greater detail in connection with the drawings, in which:

FIGS. 1, 2, and 3 are a perspective, side elevational, and bottom view, respectively, of a fastener-driving tool (a roofing tool) according to the invention;

Figure 2:
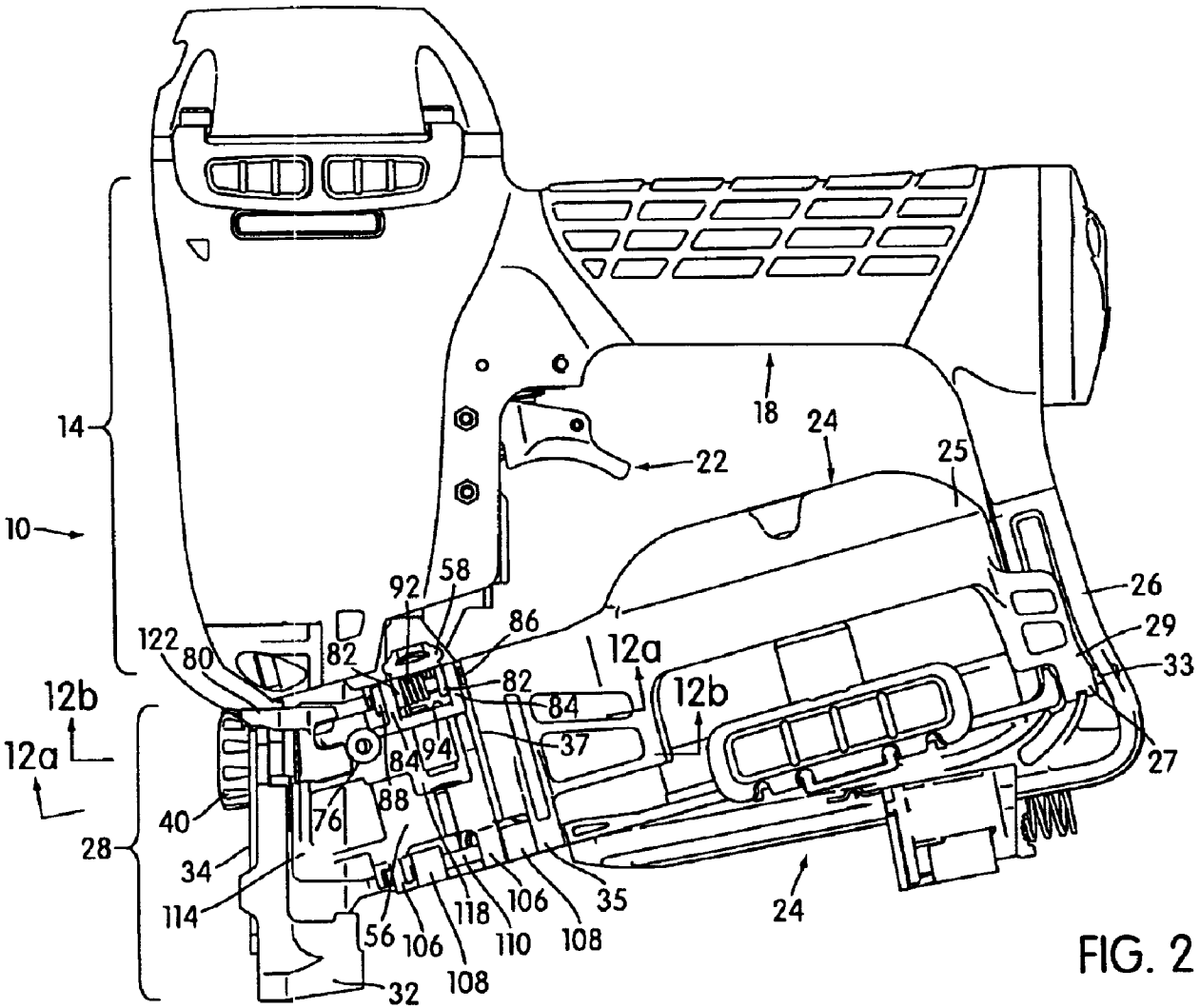
Figure 11A:
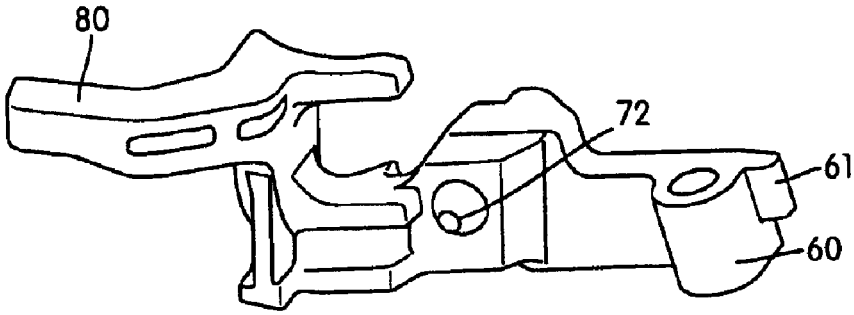
Figure 11B:
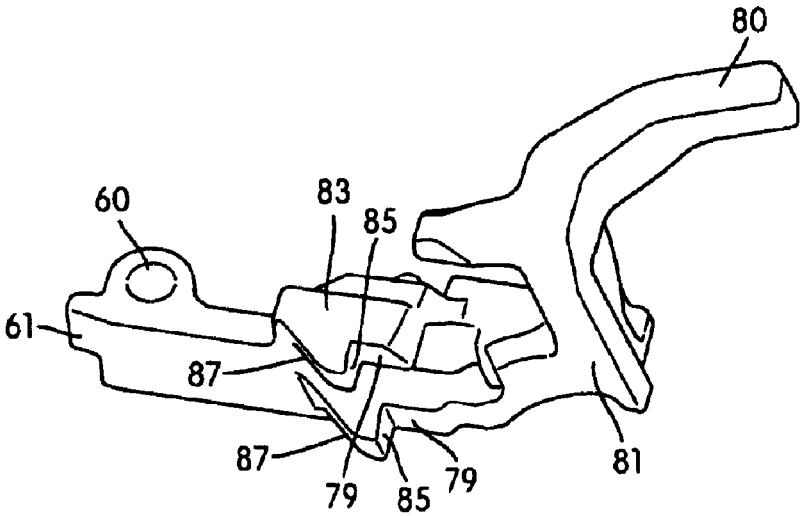
Figure 11C:
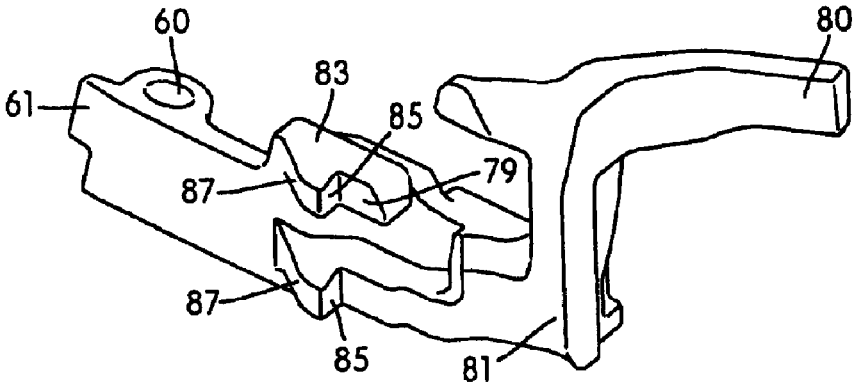
Figure 12A:
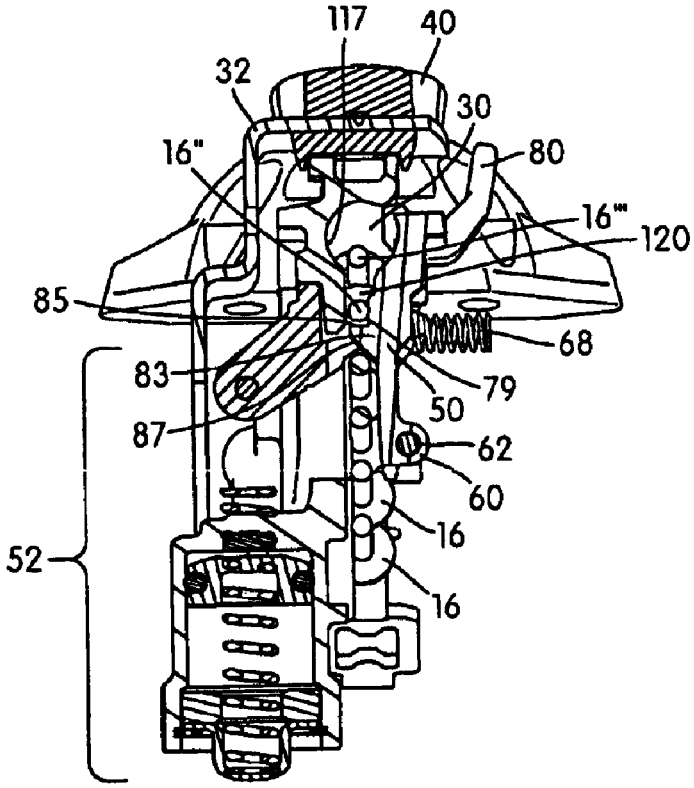
Figure 12B:
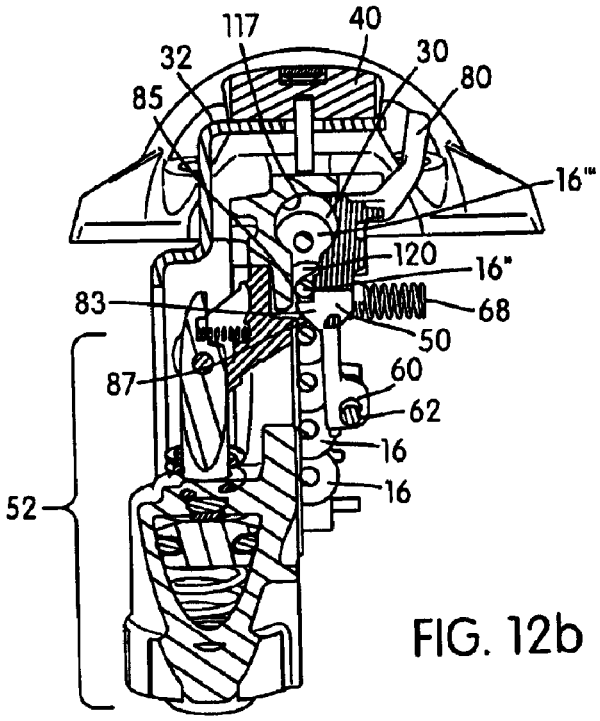
Figure 13A:
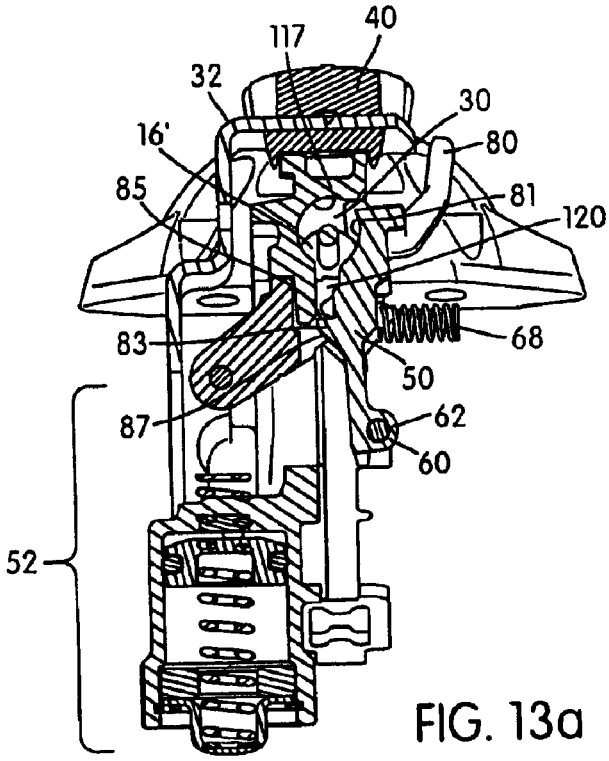
Figure 13B:
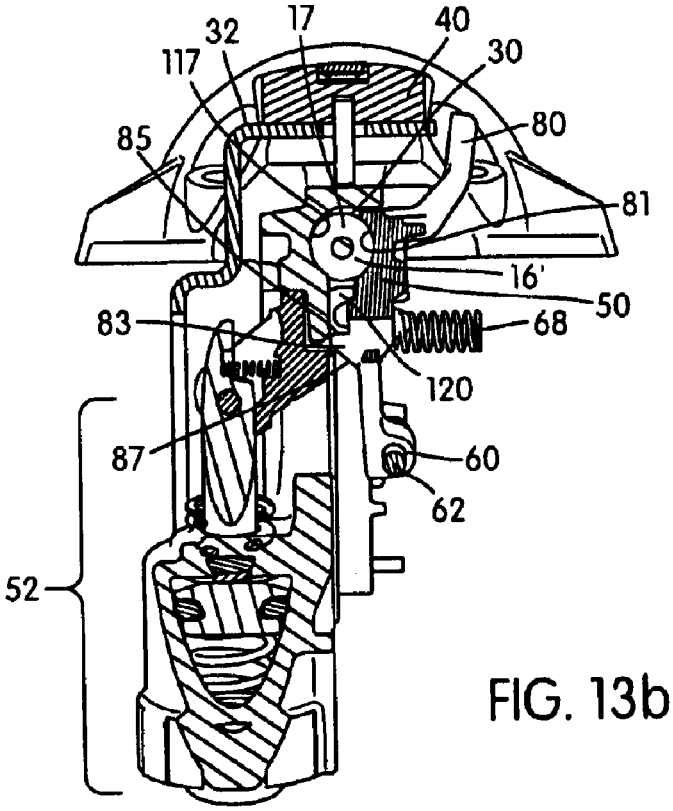
Figure 14:
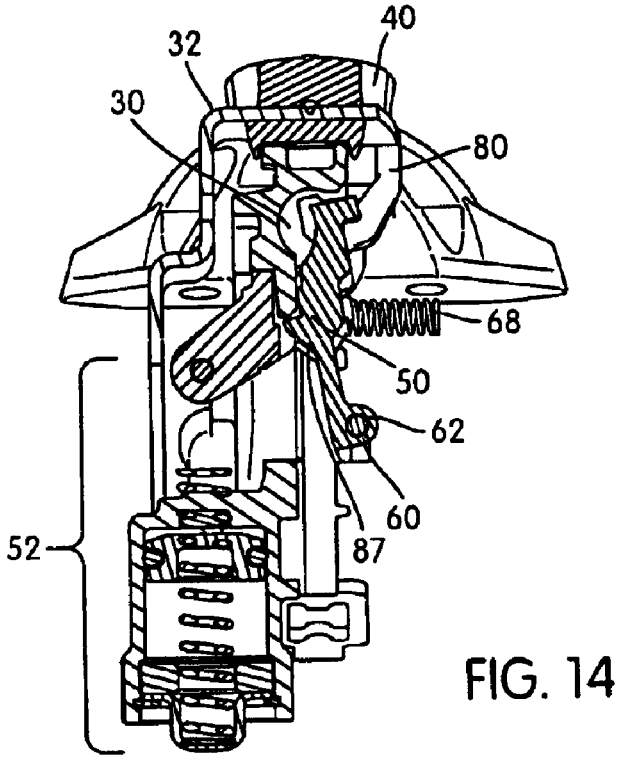

FIGS. 11*a*–11*c* are perspective views from three different angles illustrating an embodiment of an integrated function member according to the invention and utilized in the fastener-driving tool (roofing tool) illustrated in FIGS. 1–10;

FIGS. 12A and 12B are section views of the assembled nose portion of the fastener-driving tool (roofing tool), taken along lines 12*a*—12*a* and 12*b*—12*b*, respectively, in FIG. 2 and illustrating the position of the integrated function member according to the invention during general operation of the fastener-driving tool, with FIGS. 12A and 12B being taken along slightly different cutting planes to provide slightly different views;

FIGS. 13A and 13B are section views similar to FIGS. 12A and 12B and illustrating the last fastener-retaining position of the integrated function member according to the invention when a single fastener remains to be driven, with FIGS. 13A and 13B being taken along slightly different cutting planes to provide slightly different views; and FIG. 14 is a section view similar to FIGS. 12A and 13A and illustrating the dry fire lock-out position of the integrated function member according to the invention when no fasteners remain to be driven.

5. DETAILED DESCRIPTION OF PREFERRED EMBODIMENTS OF THE INVENTION

The overall arrangement of a roofing tool 10 according to the invention is illustrated in FIGS. 1–4. The roofing tool 10 has a nail-driving member 12 that is located within a main body portion 14 of the roofing tool 10. The nail-driving member 12 may, for example, be pneumatically actuated to drive nails 16 or other fasteners into a workpiece, as is known in the art. A handle portion 18 extends from the main body portion 14 and allows the roofing tool 10 to be manually manipulated. The handle portion 18 includes a thread-type connection 20 by means of which a compressor air hose is connected to the roofing tool 10 to provide high pressure air to the roofing tool 10 to operate it. The roofing tool 10 further includes a trigger mechanism 22 constituting one part of an actuating mechanism or means by which the roofing tool is actuated to drive nails 16 or other fasteners into the workpiece.

The roofing tool 10 further includes a magazine assembly including a magazine portion 24, which is configured to receive a coil of nails 16 or other fasteners. The magazine portion 24 is supported at the tail "strut" portion 26 extending from the end of the handle portion 18, and the magazine assembly is configured and arranged to feed the nails 16 or other fasteners to the nose portion 28 and along a fastener feed track 31 of the roofing tool 10.

Preferably the magazine portion 24 is configured for one-handed, side-loading operation as disclosed in U.S. Pat. No. 5,683,024 ("the '024 patent"), the disclosure of which is incorporated herein by reference. In particular, the magazine portion 24 includes a magazine cover member 25 that pivots laterally outwardly to open up the fastener magazine simultaneously with the fastener drive track access door member 56 (described in greater detail below) being opened. Thus, as illustrated in FIGS. 2 and 5–8, the magazine cover member 25 has a lug 27 formed at the end of stand-off tab 29, with cover member pivot pin 33 pivotally supporting the cover member 25. Additionally, the cover member 25 has a forward lug 35, with pivot pin 110 about which the drive track access door member 56 also pivots passing through it. Pivot pin 110 is aligned with cover member pivot pin 33. The magazine cover member 25 and the drive track access door member 56 are joined together along seam 37, e.g., by means of a tang 39 that extends from the edge of the drive track access door member 56 and that fits within a groove 41 formed in the forward edge of the magazine cover member 25. Thus, when a new supply of nails is to be loaded into the tool, the magazine portion 24 and the feed track 31 are opened simultaneously by pivoting the cover member 25 and the access door member 56 outwardly, together as a unit.

Figure 4:
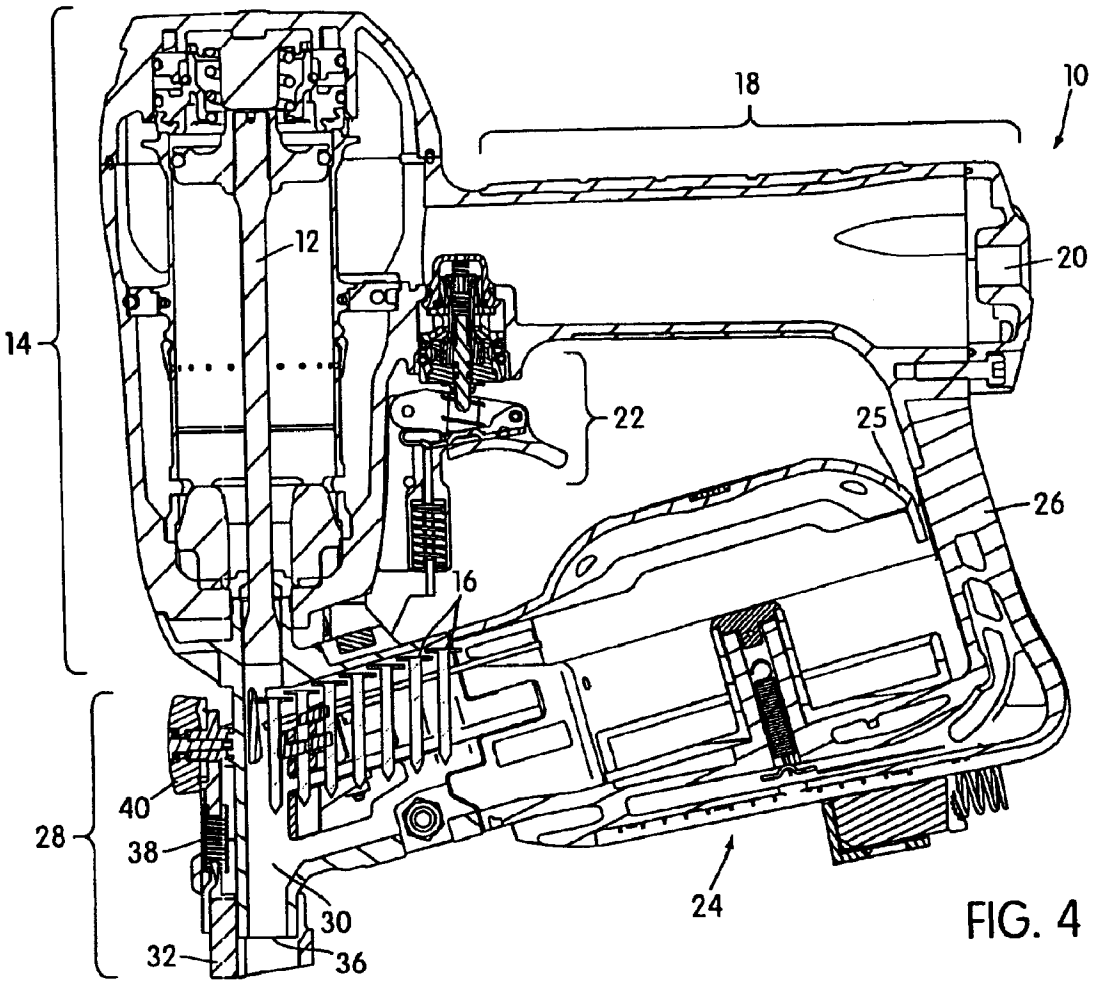
FIG. 4 is a section view taken along lines 4—4 in FIG. 3.
Figure 5:
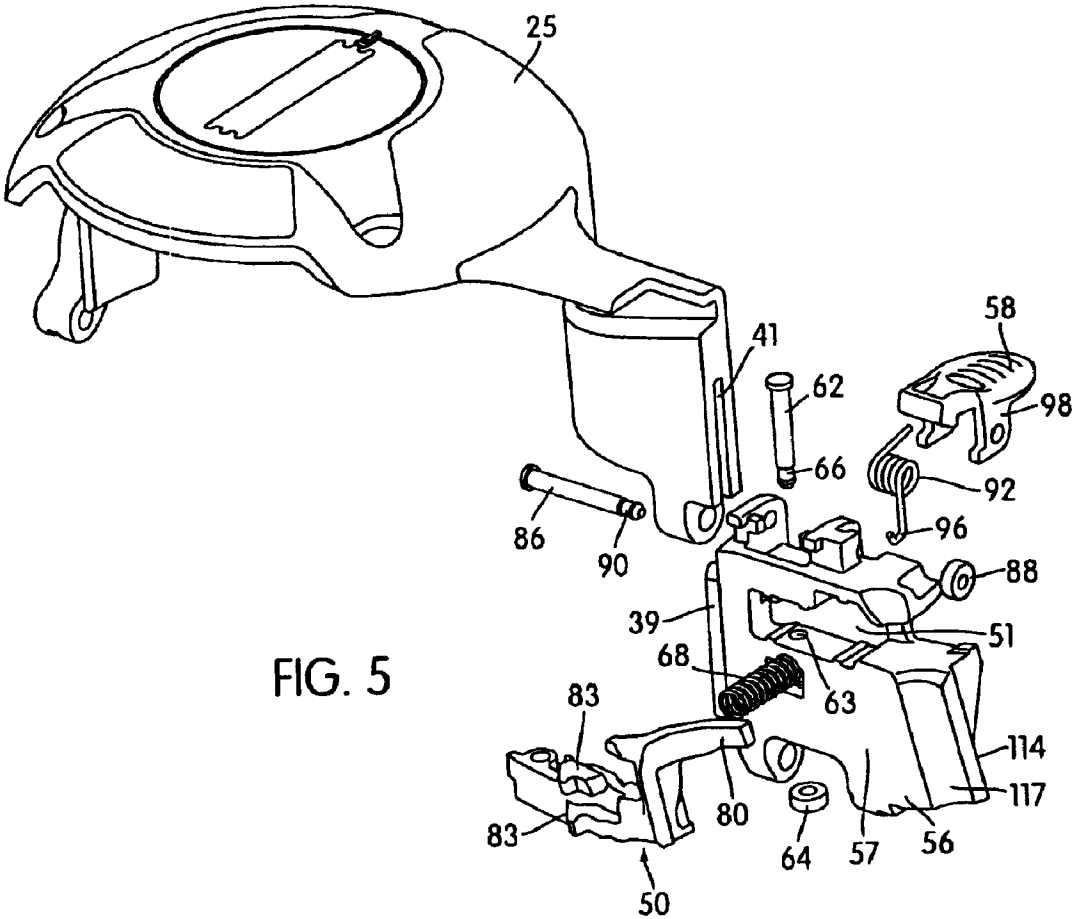
FIG. 5 is an exploded perspective view illustrating the drive track access door assembly of a roofing tool according to the invention in relation to the magazine cover member with which it is assembled.
Figure 6:
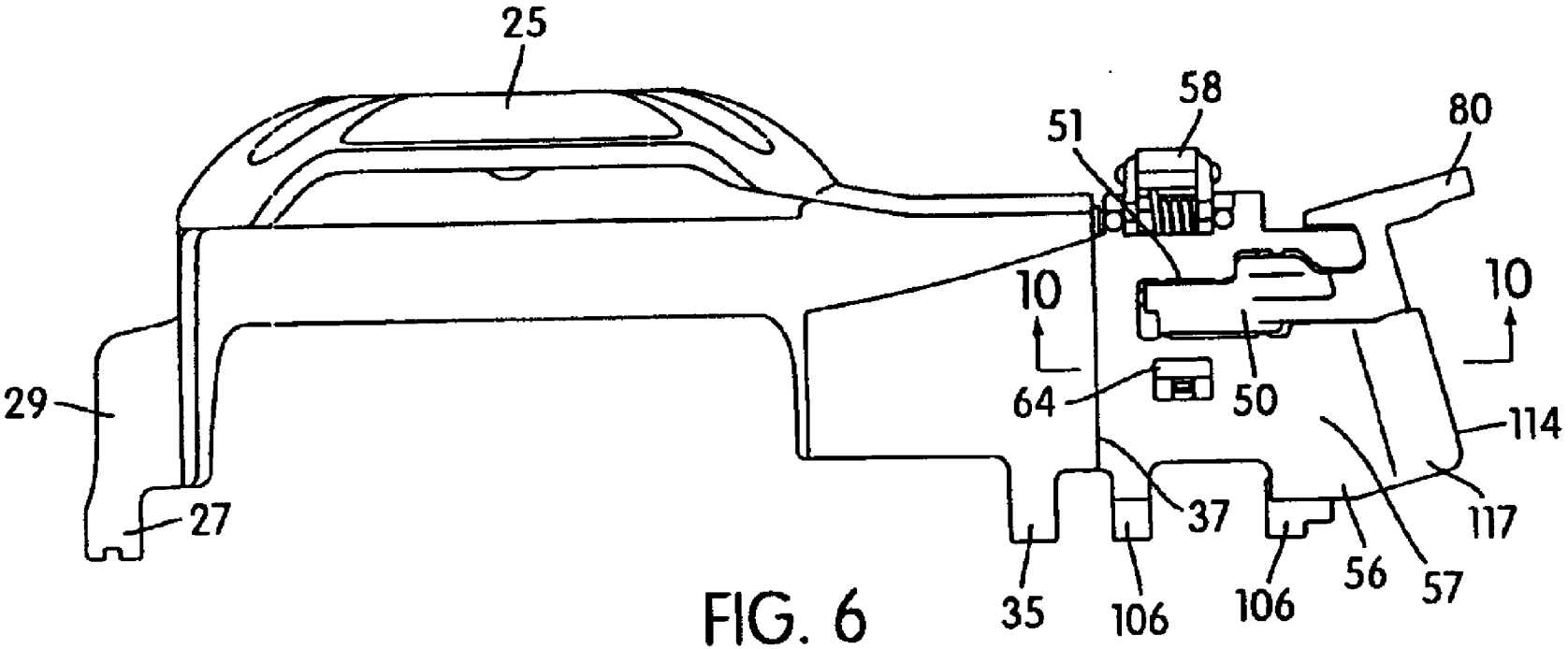
FIGS. 6 and 7 are side elevational views, from opposite sides, illustrating the drive track access door/magazine cover member assembly shown in FIG. 5.
Figure 7:
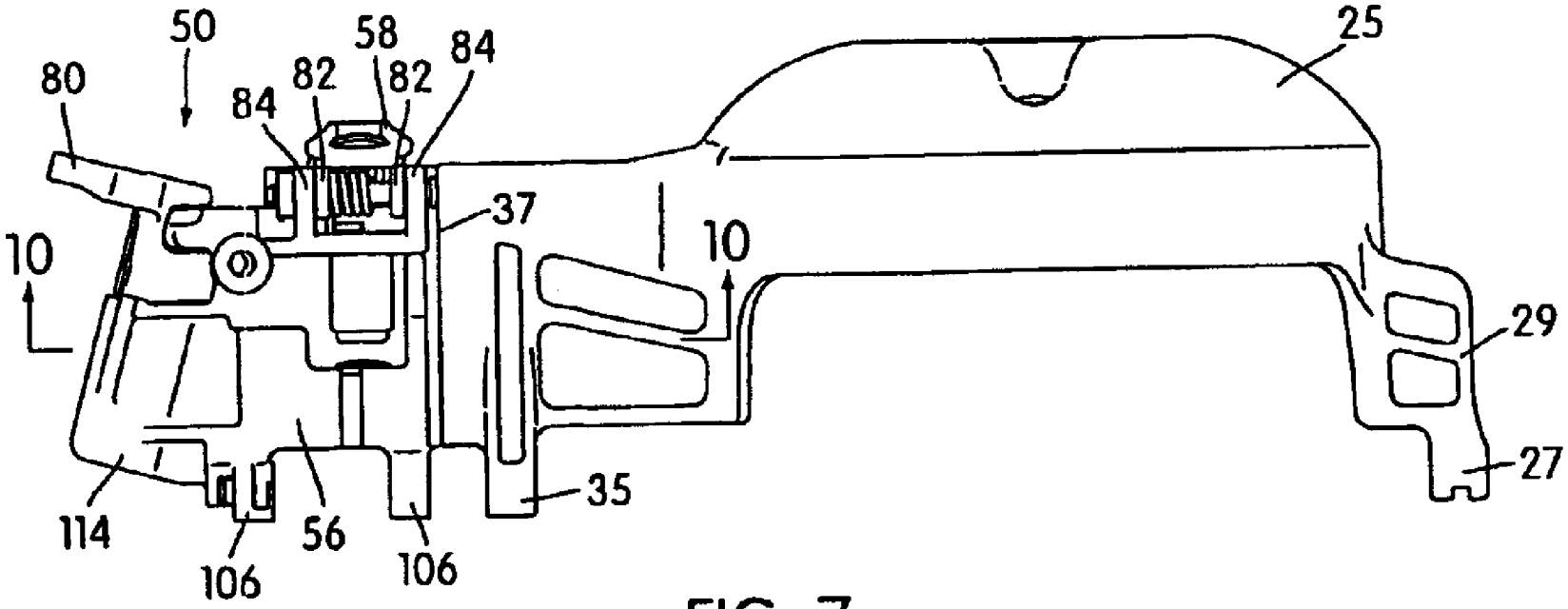
Figure 8:
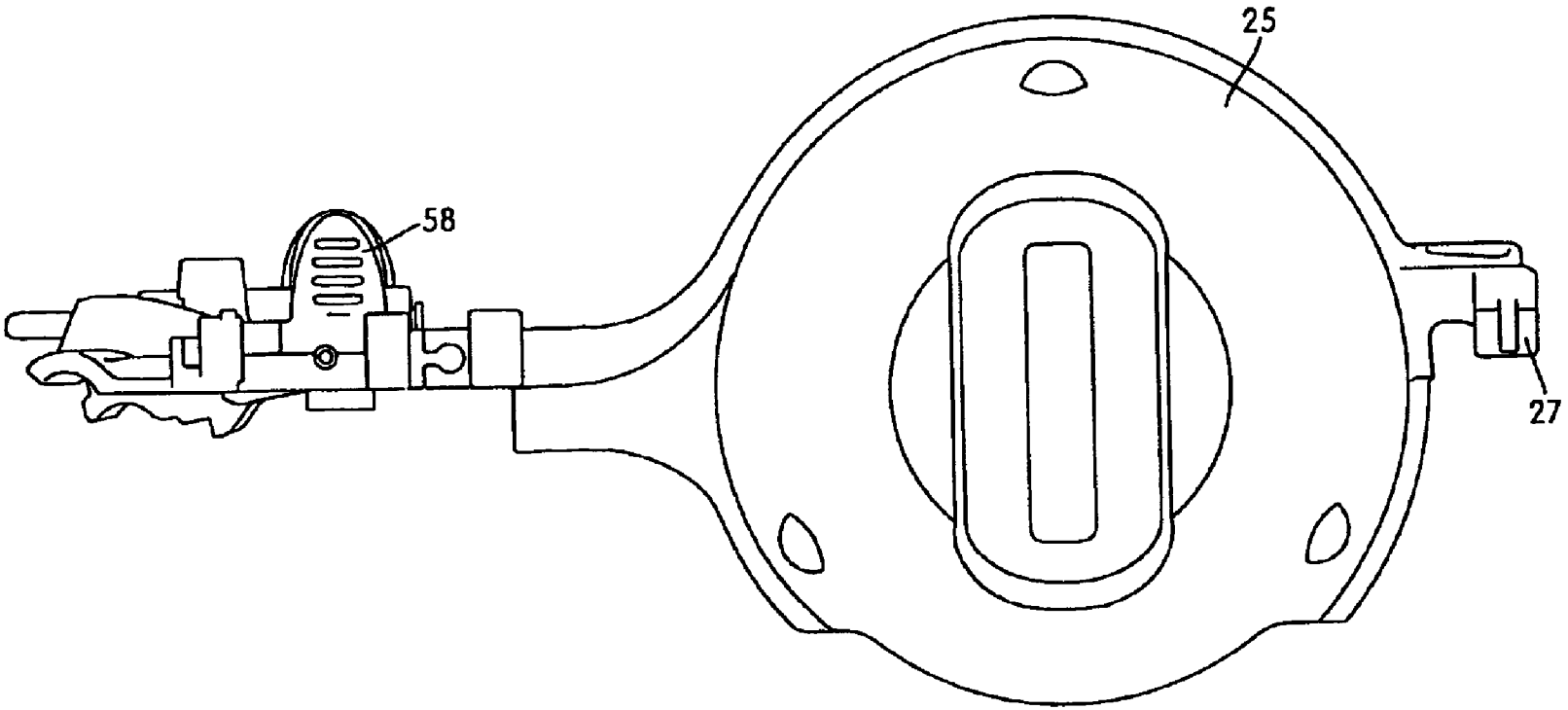
FIG. 8 is a top or plan view thereof.

The nose portion 28 of the roofing tool 10 defines a drive track 30 into which the nail 16 (or other fastener) which is about to be driven into the workpiece is positioned, as shown in FIG. 4. The nose portion 28 includes a spring-biased contact arm 32 forming part of a conventional contact trip assembly which constitutes the other part of the actuating means of the tool 10. The contact arm 32 is attached to the front of the nose portion 28 in a manner that permits the contact arm 32 to slide up and down. The contact arm 32 is interconnected with the trigger mechanism 22 by means of a linkage member 34 (FIG. 9) or other linkage mechanism. The linkage member 34 interlocks the trigger mechanism 22 with the contact arm 32 such that the trigger mechanism 22 cannot be depressed to activate the roofing tool unless the nose portion 28 is pressed against the workpiece with sufficient force to press the end surface 36 of the drive track 30 against the workpiece and drive the contact arm 32 up toward the main body portion 14 of the roofing tool 10. The amount of travel of the contact arm 32 required to do so can be varied to suit the operator's needs by means of travel adjustment knob 40, with tension spring 38 biasing the contact arm 32 against the contact arm linkage member 34.

To this extent, the construction and arrangement of the roofing tool 10 according to the invention is relatively conventional as disclosed in the above cited '024 patent. Also as disclosed in the '024 patent and U.S. Pat. No. 4,858,812 ("the '812 patent"), the tool 10 is preferably of the pneumatically actuated type including a pneumatically actuated reciprocating fastener feed mechanism 52 which is pneumatically interconnected with the pneumatic fastener driving system. The '812 patent discloses such an interconnecting pneumatic driving and feeding system and the disclosure of the '812 patent is hereby incorporated by reference into the present specification for purposes of such disclosure.

The integrated driving and feeding system of the '812 patent is particularly configured to function with a fastener 16 of the type herein disclosed as well as in the '024 and '812 patents. In its most specific aspects, the fastener 16 is a headed roofing nail.

The roofing nails 16 include a shank and a head on one end of the shank which are packaged in a collated succession by flexible elongated structure such as a pair of parallel wires welded to the shanks of each nail in the succession so as to maintain them in substantially parallel relation. The wires are welded in angular relation (75°) across the parallel nail shanks. The succession of nails is then wound into a coil formation in which the heads of alternate convolutes are disposed in overlapped and underlapped relation with respect to the heads of the preceding convolutes so as to present pointed and headed ends of the coiled package which are substantially flat. It will be understood that the present invention contemplates selecting any one of a series of different nail coils wherein the nails of the coils vary in length from half inch to four inches. Other types of flat coiled fasteners herein contemplated are disclosed in U.S. Pat. Nos. 3,450,255, 3,543,987, 3,558,031, and 4,319,705, the disclosure of all of which are hereby incorporated by reference into the present specification. Also, rather than wire weld, plastic collation or paper collation can be used.

Figure 1:
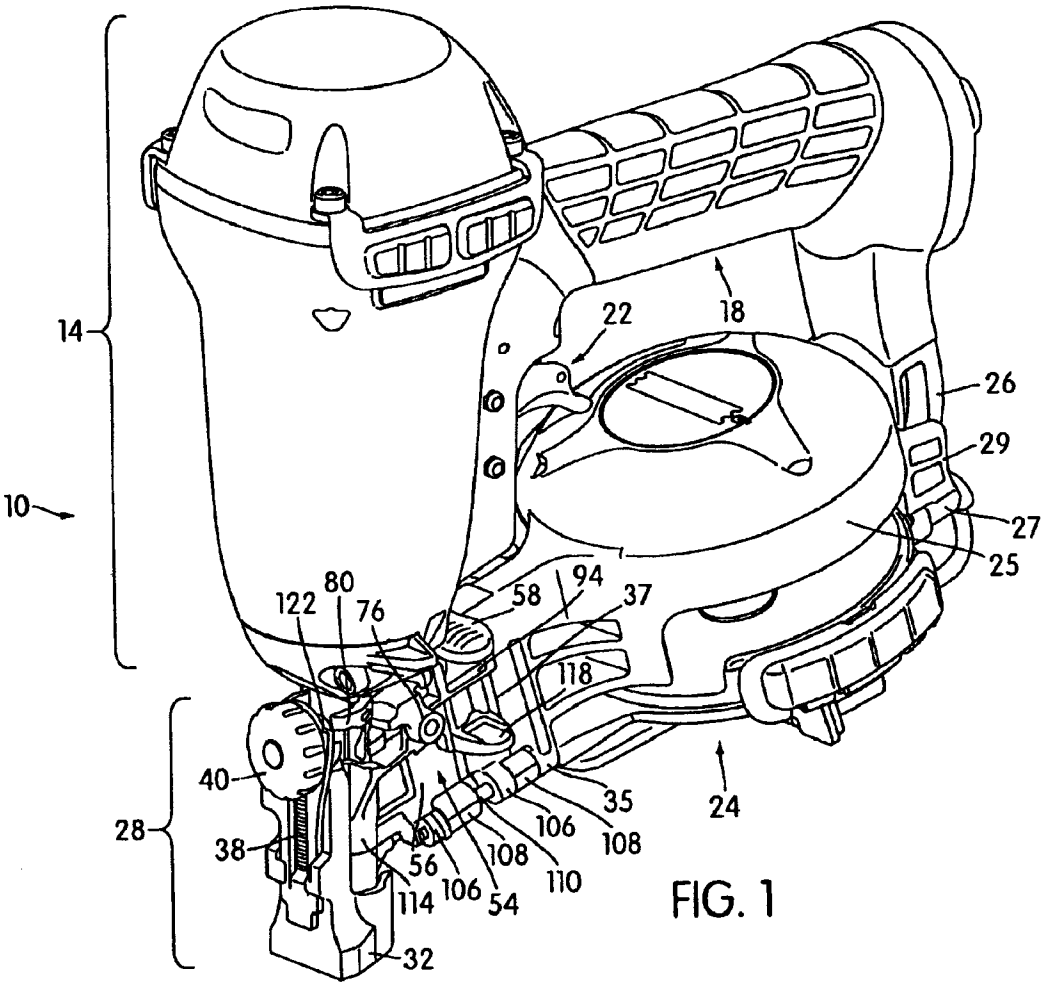
Figure 3:
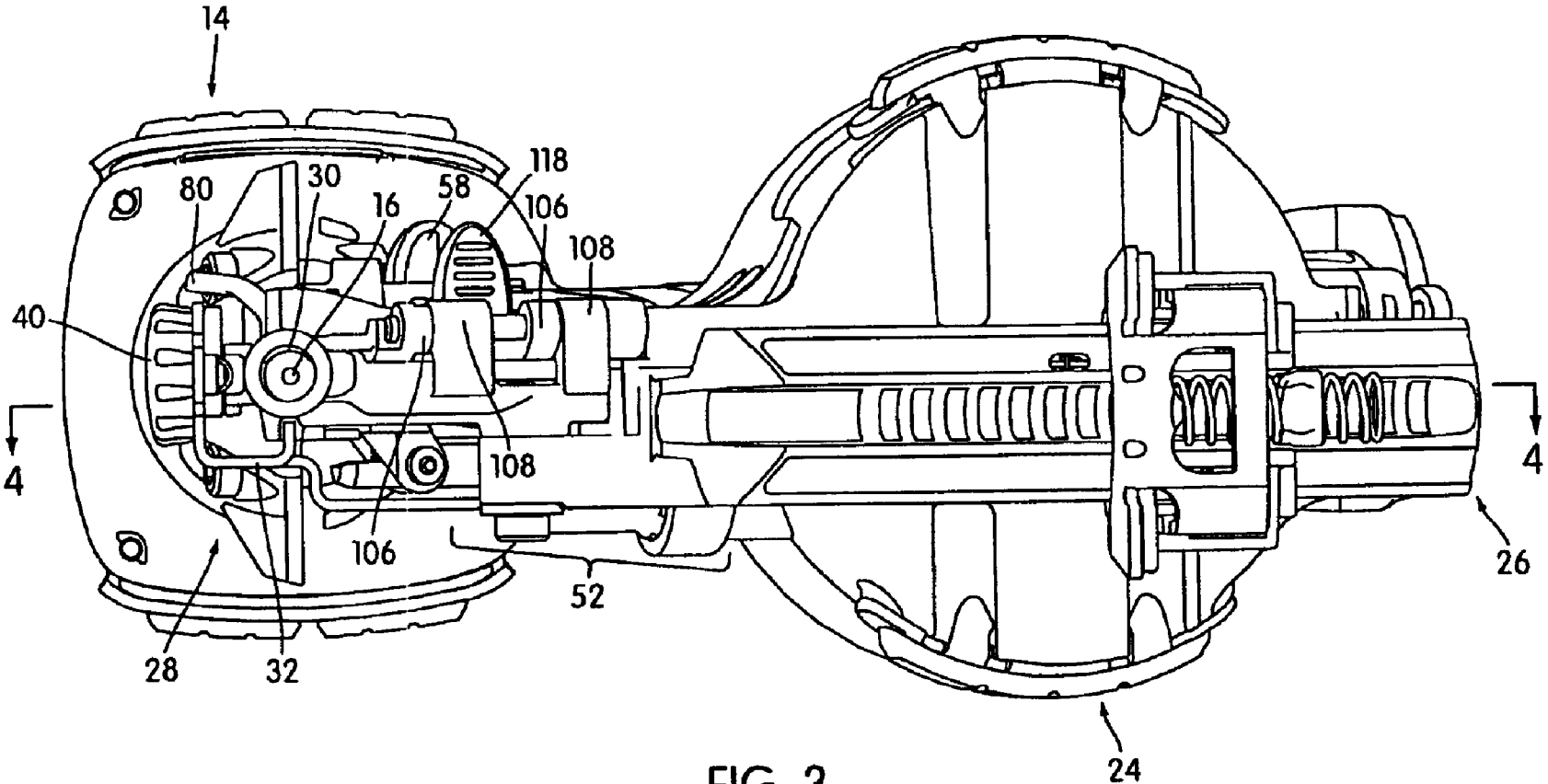

Features of the roofing tool 10 that embody the present invention are visible in FIGS. 1–3 and are illustrated in greater detail in FIGS. 5–11. According to the invention, the roofing tool 10 has an integrated function member 50 that performs three functions. In particular, during general operation of the roofing tool 10, the integrated function member 50 functions as a check pawl to prevent the strip of nails 16 from sliding backward due to operation of the feed pawl mechanism 52, as illustrated in FIGS. 12A and 12B and described in greater detail below. When a single nail remains to be driven, the integrated function member 50 retains the last nail 16' securely in the drive track 30, as illustrated in FIGS. 13A and 13B and described in greater detail below. Subsequently, when the last nail 16' has been driven into the workpiece, the integrated function member 50 blocks movement of the contact arm 32 to prevent actuation of the roofing tool 10, as illustrated in FIG. 14 and described in greater detail below.

As shown in FIGS. 5–11, the integrated function member 50 is a lever-type structure that is assembled into the overall access door assembly 54 by means of which the operator accesses the drive track 30 and feed track 31 to load a new supply of fasteners. The access door assembly 54 includes door member 56, release lever 58, and the integrated function member 50. The integrated function member 50 has a lug 60 and is pivotally secured within recess 51 formed in the nail-facing side 57 of the door member 56 by means of pivot pin 62, which passes through the lug 60 and corresponding apertures 63 formed on or in the nail-facing surface of the door member 56. Retaining ring 64 fits over the end of pivot pin 62 and seats within circumferential groove 66 to secure the pivot pin 62, and hence the integrated function member 50, within the recess 51.

The integrated function member 50 further has a bearing surface 79; a check pawl shoulder portion 83; an arcuate last-nail-retaining portion 81; and a dry fire-lockout finger 80 extending from it, the purpose and function of each of which will be described in greater detail below. Preferably, the arcuate shape of the last-nail retaining portion 81 of the integrated function member 50 matches the arcuate shape of the generally half-cylindrical extension portion 114 formed at the forwardmost portion of the door member 56, as well as the arcuate shape of the inner surface 117 of the half-cylindrical groove portion 116 formed in the nose portion 28, so that the last-nail retaining portion 81 cooperates with those portions of the tool to define a portion of the drive track 30.

A compression spring 68 is positioned between the integrated function member 50 and the door member 56. The compression spring 68 biases the integrated function member 50 toward the nails 16 when the access door assembly is closed and latched in the operating position. One end 70 of the compression spring 68 fits over boss 72 extending from the surface of the integrated function member 50, and the other end 74 of the compression spring 68 fits within an annular or circular recess 76 that is formed in the door member 56. This configuration and assembly keeps the compression spring 68 properly positioned to bias or urge the integrated function member toward the collation of nails located in the feed track 31 of the roofing tool 10 when the assembly 54 is closed and latched. Tab 61 at the end of the integrated function member 50 prevents the integration function member 50 from over-pivoting outwardly to such an extent that the compression spring 68 could fall out of the access door assembly 54 when it is opened.

The access door assembly (and magazine cover member 25) is opened using release lever 58. Release lever 58 has a pair of lugs 82 depending from a lower surface thereof, and the lugs 82 are spaced to fit between lugs 84 formed on the door member 56. Pivot pin 86 passes through the lugs 82 and 84 to fix the release lever 58 in position on the door member 56, and retaining ring 88 fits over the end of pivot pin 86 and into circumferential groove 90 at the end of the pivot pin 86 to secure the pivot pin 86 in position.

The pivot pin 86 passes through a torsion spring 92, which is positioned between the under-surface of the release lever 58 and an opposing surface 94 of the door member 56 located between the lugs 84. Hook portion 96 of the torsion spring 92 engages edge 98 of the door member 56, and free end 100 of torsion spring 92 engages the under-surface of the release lever 58 to bias it in the direction of arrow 102. A latching portion 104 of the release lever 58 engages a cooperatively positioned latching edge or groove (not shown) formed in the opposing side of the nose portion 28 of the roofing tool 10.

The door member 56 has additional lugs 106 that are cooperatively spaced to interengage with lugs 108 extending from the opposing side of the nose portion 28 of the roofing tool 10. The door member 56 (and hence the overall access door assembly 54) is secured to the nose portion 28 of the roofing tool 10 by means of pivot pin 110, which passes through the lugs 106 and 108. The door member 56 further has an extension portion 114, as noted above, which defines a generally half-cylindrical surface formed at the forwardmost portion of the door member 56. The half-cylindrical extension portion 114 cooperates with a groove portion 116 defining a mating generally half-cylindrical surface formed in the opposing side of the nose portion 28. The mating surfaces define at least a portion of the drive track 30 when the access door assembly 54 is closed.

With this configuration, when it is necessary to load a new supply of nails into the roofing tool 10, the outer end of the release lever 58 is depressed, e.g., by the operator placing the side of his or her first knuckle under tab 118 extending from the door member 56 and pressing on the outer end of the release lever 58 with his or her thumb. So pressing the release lever 58 causes it to rotate against the bias of torsion spring 92, i.e., in the direction opposite to arrow 102, which disengages the latching portion 104 of the release lever 58 from the cooperating latching edge or groove (not shown) formed in the opposing side of the nose portion 28. Thus, the access door assembly 54 (and magazine cover member 25) can be pivoted about pivot pin 110 (and pivot pin 33), outwardly and away from the fastener feed track 31, to gain access to the drive track 30 and fastener feed track 31.

Figure 9:
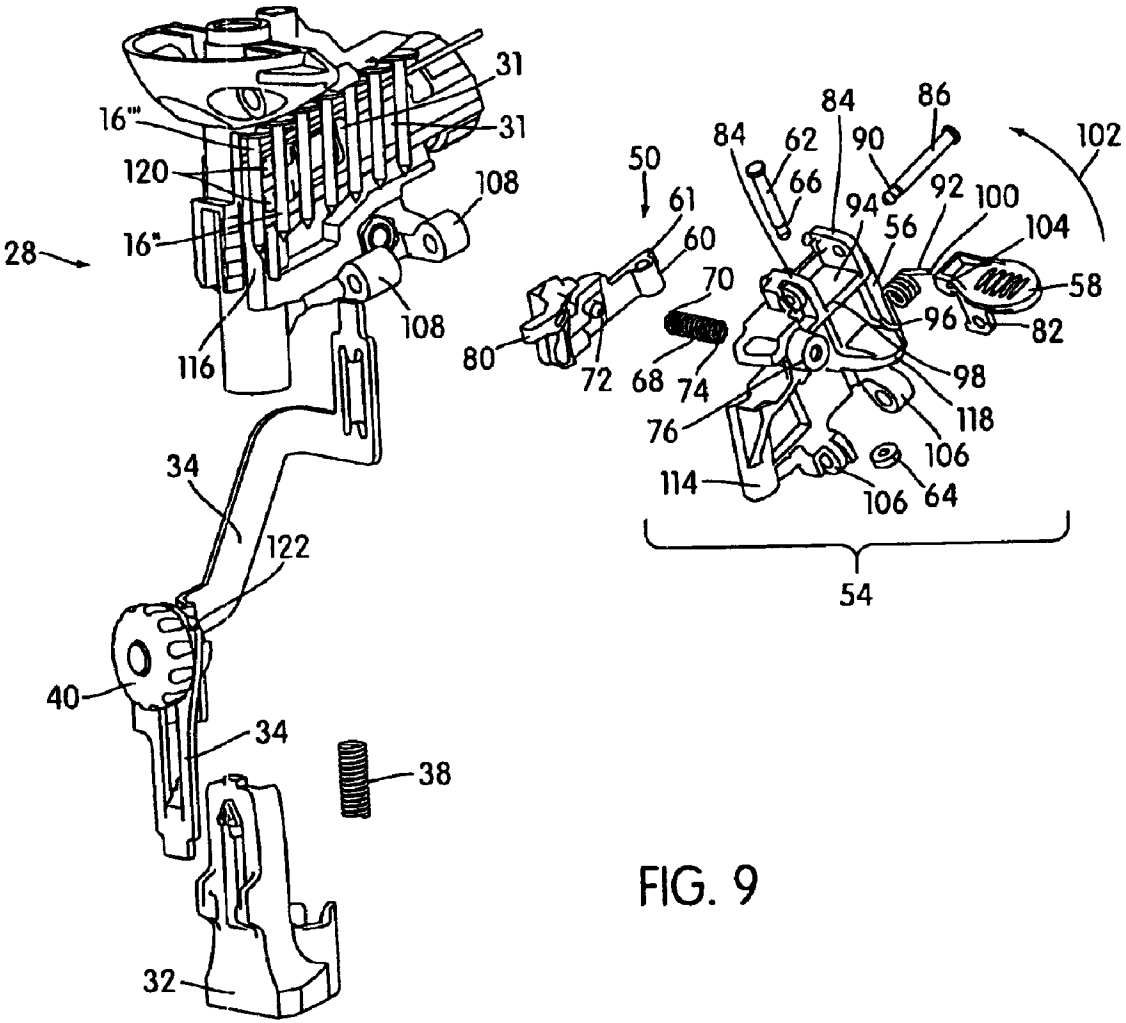
FIG. 9 is an exploded perspective view illustrating the nose portion of a fastener-driving tool (roofing tool) according to the invention.
Figure 10:
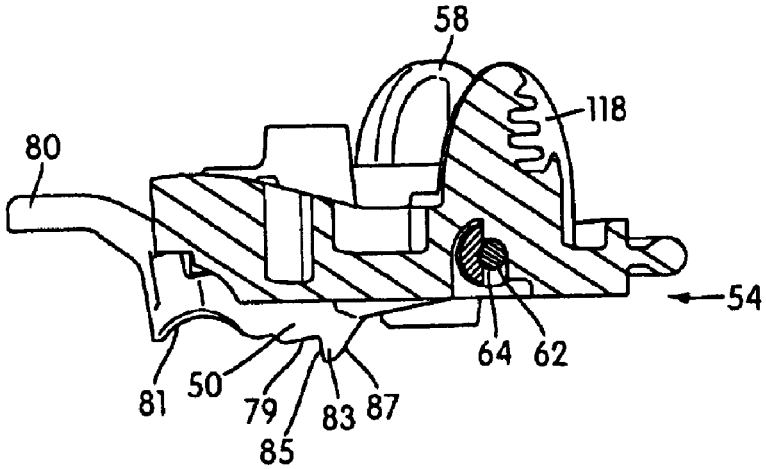
FIG. 10 is a section view of the fastener-driving tool access door assembly, as assembled, taken along lines 10—10 in FIGS. 6 and 7.

The operator then positions the leading end of the strip of nails along the feed track 31, as shown in FIG. 9, with the "second" nail 16" positioned between the teeth 120 of the feed pawl 121 of the reciprocating feed mechanism 52 and with the first nail 16'" positioned within the generally half-cylindrical portion 116 formed in the nose portion 28. The access door assembly 54 (and magazine cover member 25) is then closed by pivoting it back toward the feed track 31 and pressing it toward the feed track until the release lever 58 engages the mating latching edge or groove formed on the opposing side of the nose portion 28. At this point, the access door assembly 54 is secured in position for operation of the roofing tool 10, with the generally half-cylindrical extension portion 114 of the door assembly 54 and the half-cylindrical groove portion 116 formed in the nose portion 28 cooperating to define at least a portion of the drive track 30 and with the integrated function member 50 being urged by compression spring 68 toward the nail track 31 for proper operation of the integrated function member 50.

That operation of the integrated function member 50 will now be described with reference to FIGS. 12A, 12B, 13A, 13B, and 14. (The entirety of the access door assembly 54 (i.e., including door member 56) is not shown in these figures for clarity of illustration.) During general operation of the roofing tool 10, the compression spring 68 urges the integrated function member 50 toward the feed track 31, as shown in FIGS. 12A and 12B. Furthermore, during this general operation of the roofing tool, bearing surface 79 of the integrated function member 50 bears against the shanks of the nails 16, which keeps the integrated function member in the proper general operation position.

In this general operation position, the integrated function member 50 functions as a check pawl. In particular, in this position, check pawl shoulder portion 83 extending from the body of the integrated function member 50 extends into the space between the second nail 16" and the following nail (not labeled). The pneumatic system of the roofing tool 10 is operable such that as soon as the first nail 16'" is driven, as the nail driving member 12 is retracting within the drive track 30, the reciprocating feed mechanism 52 operates to cause the feed pawl teeth 120 to move backward (i.e., away from the drive track 30) to "grab" or "pick up" the second nail 16". As the feed pawl teeth 120 are retracting or sliding backward, the check pawl shoulder portion 83 prevents the nails from being pushed backwards by the feed pawl teeth 120 as soon as the shank of the second nail 16" contacts the blocking surface 85 of the check pawl shoulder portion 83. Thus, the feed pawl teeth 120 "ride up and over" the shanks of the nails 16.

Once the feed pawl teeth 120 have moved backward completely and caught the second nail 16", the feed pawl 121 moves forward to advance the strip of nails. As the nails move forward along the feed track 31, the nail shanks push the integrated function member 50 out of the way, against the biasing action of compression spring 68, by bearing against cam surface 87 of the check pawl shoulder portion 83. The bearing surface 79 will move slightly away from the nail shanks as the nail shanks move across the check pawl shoulder portion 83, and will then be pushed back into contact with the nail shanks by the compression spring 68 once the nail shanks clear the check pawl shoulder portion 83. This bearing contact by the bearing surface 79 against the nail shanks limits the amount by which the integrated function member 50 moves toward the opposing fastener feed track 31, which keeps the arcuate, last nail-retaining portion 81 of the integrated function member 50 in proper position to define a portion of the drive track 30 during general operation of the tool, as noted above.

After the second-to-last nail 16'" has been driven, the feed mechanism 52 (i.e., the feed pawl teeth 120) advances the last nail in the strip into the drive track 30, as illustrated in FIGS. 13A and 13B. At this point, because no nails remain along the feed track 31 for the bearing surface 79 of the integrated function member 50 to bear against, the integrated function member 50 is able to pivot slightly closer to the feed track 31 than is possible when two or more nails are in the roofing tool 10 and waiting to be driven. As a result, the integrated function member 50 pivots far enough toward the feed track 31 for the arcuate surface of the last nail-retaining portion 81 to contact the head 17 of the last nail and press it or lightly clamp it against the arcuate inner surface 117 of the half-cylindrical groove portion 116 formed in the nose portion 28, i.e., against the side-wall of the drive track 30. Thus, when the integrated function member 50 is in the position illustrated in FIGS. 13A and 13B, it functions to secure the last nail in the strip or supply of nails securely within the drive track 30, thus permitting it to be driven and preventing it from simply falling out of the roofing tool.

The procedure by which the last nail is retained within the drive track 30 constitutes a step in a last nail-retaining method embodied in the present invention. Thus, in accordance with the principles of the present invention, there is provided a method of retaining a last nail 16' (or other headed fastener) within the fastener drive track 30 of the power-operated fastener-driving tool 10 so as to prevent the last nail 16' from falling out of the drive track 30 without being driven by the operation of the tool 10. In particular, the method entails moving the last nail 16' into the drive track 30 in a predetermined direction and engaging the head 17 of the last nail 16' in the drive track along a periphery of the head 17 with a first head-engaging surface (i.e., the arcuate last-nail-retaining portion 81), at a position disposed laterally with respect to the predetermined direction of movement of the last nail 16' into the drive track 30. Thus, a force is applied to the head 17 of the last nail 16' by the engagement of the arcuate last-nail-retaining portion 81, which force causes the head 17 of the last nail 16' to be biased into engagement with a wall surface defining a portion of the drive track 30 (i.e., the arcuate inner surface 117 of the half-cylindrical groove portion 116 formed in the nose portion 28) which is laterally opposite from the position of engagement of the first head-engaging surface (i.e., the arcuate last-nail-retaining portion 81) so that the head of the last nail 16' is gripped between the arcuate last-nail-retaining portion 81 and the arcuate inner surface 117 of the half-cylindrical groove portion 116.

Once the last nail has been driven from the drive track 30 the integrated function member 50 pivots all the way toward the feed track 31, with the arcuate last nail-retaining portion 81 "collapsing" in toward the arcuate inner surface 117 of the half-cylindrical groove portion 116 as shown in FIG. 14. When the integrated function member 50 pivots this far toward the feed track 31, the dry fire lock-out finger 80 moves into a blocking position. This prevents the contact arm 32 from being moved toward the main body portion 14 of the roofing tool 10, thereby preventing actuation of the trigger mechanism 22 and hence actuation of the roofing tool 10 when no more nails are present in the drive track 30. In particular, as shown in FIGS. 1, 2, and 9, the contact arm linkage member 34 has a lock-out shoulder surface 122 at an upper (i.e., closer to the main body portion 14) region thereof. The contact arm linkage member 34 and the integrated function member 50 are cooperatively configured such that when the last nail is driven from the roofing tool and no nails remain, as the integrated function member 50 pivots into the position shown in FIG. 14, the dry fire lock-out finger 80 moves into position immediately adjacent the lock-out shoulder surface 122. As a result, the dry fire lock-out finger 80 blocks travel of the contact arm 32, and hence it prevents actuation of the trigger mechanism 22 and operation of the roofing tool 10 when all nails have been driven. (Depending on the relative configurations and/or dimensions of the contact arm 32, the contact arm linkage member 34, and/or the integrated function member 50, the dry fire lock-out finger may make blocking contact with a portion of the contact arm 32 instead of with the contact arm linkage member 34.)

It will be appreciated that the foregoing description of one embodiment of the invention is for illustration purposes only and is not intended to be limiting. Other embodiments, incorporating variations from or modifications to the disclosed embodiment, will occur to those having skill in the art. For example, although the integrated function member 50 is disclosed as being incorporated into the door assembly 54 by means of which access is gained to the drive track portion 31, the integrated function member 50 could be positioned elsewhere within the nose assembly, so long as it is positioned and configured to function in the manner described above. Moreover, although the integrated function member 50 as disclosed above provides all three described functions (check pawl, last nail-retainer, and dry fire lock-out), it is contemplated that an integrated function member can be provided in which the integrated function member performs any combination of two of the three functions (for example, where a highly desirable or suitable structure or mechanism is already incorporated into a given tool design for performing one of the functions). Furthermore, although the invention has been described herein in the context of a roofing tool, which drives nails into a substrate, the invention may also be incorporated in other fastener-driving tools. Additionally, although the invention has been disclosed in the context of a roofing tool that uses a coil-type magazine, the invention may also be incorporated into a fastener-driving tool that uses a stick-type magazine (and, if desired, may provide just the last nail-retaining or last fastener-retaining function with the dry fire lock-out function). These and other such modifications to and departures from the embodiments described herein are deemed to be within the scope of the following claims.

We claim:

1. A fastener-driving tool for driving fasteners into a workpiece, said fastener-driving tool comprising:

a main body portion;

a nose portion attached to said main body portion, said nose portion having a fastener drive track therein that is configured to receive a fastener to be driven into the workpiece;

a fastener-driving member that drives the fastener that is to be driven out of said drive track and into the workpiece; and an actuator that is actuated to cause said fastener-driving member to drive the fasteners into the workpiece;

wherein said fastener-driving tool further comprises an integrated function member having a last-fastener-retaining portion and a dry fire lock-out portion, said integrated function member being configured and operatively disposed relative to said drive track and said actuator such that 1) when a last fastener remains to be driven into the workpiece, said last-fastener-retaining portion holds the last fastener within said drive track to prevent the last fastener from falling out of said drive track without being driven into the workpiece and 2) such that when no fasteners remain within said fastener-driving tool, said dry fire lock-out portion prevents operation of said actuator, thereby preventing fastener-driving movement of said fastener-driving member.

2. The fastener-driving tool of claim 1, wherein said nose portion further defines a fastener feed track that is configured to receive a succession of fasteners from a magazine and to guide the succession of fasteners toward and into said drive track, said magazine assembly including a feed mechanism for advancing the succession fasteners in guided relation with said feed track so that a leading fastener is moved into said drive track.

3. The fastener driving tool of claim 2 wherein said fasteners are headed nails each having a shank and a head on one end of said shank and being collated with the shanks in parallel relation to one another and retained in said parallel relation by flexible elongated structure fixed to the shanks thereof, said magazine portion being configured to retain a succession of collated and retained headed nails firmed into a coil formation so as to allow a leading succession of the coil formation to be moved outwardly thereof mud into the fastener feed track to be advanced therealong by said feed mechanism.

4. The fastener driving tool of claim 3, wherein said last fastener-retaining portion includes an arcuate head engaging surface disposed at a position disposed laterally with respect to the direction of movement of a last headed nail into said drive track, said arcuate surface being biased to move into engagement with a peripheral portion of the head of the last headed nail in said drive track and to grip the engaged head between said arcuate surface and a laterally spaced opposite arcuate surface of said drive track so that the last headed nail can be driven out of said drive track while being gripped.

5. The fastener-driving tool of claim 4, wherein said integrated function member is biased toward said fastener feed track by a spring.

6. The fastener-driving tool of claim 5, wherein said nose portion further bas a drive track access door by means of which said fastener feed track is accessed to load a new supply of fasteners into said nose portion, and wherein said integrated function member is operatively connected to said drive track access door and is configured such that when said drive track access door is in a closed position for operation of said fastener-driving tool, said integrated function member is urged toward said fastener feed track by said spring.

7. The fastener-driving tool of claim 6, wherein said integrated function member is disposed within a recess formed on a drive-track-facing side of said drive track access door.

8. The fastener-driving tool of claim 6, wherein said integrated function member is generally lever-shaped and is pivotally mounted near an end thereof to said drive track access door.

9. The fastener-driving tool of claim 4, wherein said fasteners are nails and said fastener-driving tool is a roofing tool.

10. The fastener-driving tool of claim 9, wherein said fastener-driving tool is pneumatically actuated.

11. The fastener-driving tool of claim 1, wherein said dry fire lock-out portion prevents operation of said actuator by blocking movement of at least one component of said actuator.

12. The fastener-driving tool of claim 11, wherein said actuator comprises a trigger mechanism, a contact arm that is configured and disposed along said nose portion so as to move along said nose portion as the workpiece-contacting end of said drive track is moved toward a fastener-driving location on the workpiece, and a contact arm linkage mechanism operatively interconnecting or interlocking said trigger mechanism with said contact arm, whereby said trigger mechanism cannot be operated to actuate said fastener-driving tool until the workpiece-contacting end of said track is within a predetermined or preselected distance from the fastener-driving location on the workpiece.

13. The fastener-driving tool of claim 12, wherein said integrated function member is configured and disposed relative to said actuator such that when no fasteners remain within said fastener drive track, said dry fire lock-out portion prevents operation of said actuator by blocking travel of said contact arm or said contact arm linkage mechanism.

14. The fastener-driving tool of claim 13, wherein said dry fire lock-out portion comprises a finger-shaped extension extending from a main body portion of said integrated function member.

15. The fastener-driving tool of claim 12, wherein said nose portion further has a drive track access door by means of which said fastener feed track is accessed to load a new supply of fasteners into said magazine assembly wherein said integrated function member is operatively connected to said drive track access door and is configured such that when said drive track access door is in a closed position for operation of said fastener-driving tool, said integrated function member is urged toward said fastener feed track.

16. A fastener-driving tool for driving fasteners into a workpiece, said fastener-driving tool comprising:

a main body portion; a magazine assembly including a magazine portion configured to receive therein a supply of fasteners to be driven into the workpiece;

a nose portion extending from said main body portion, said nose portion having a fastener drive track therein that is configured to receive a header fastener to be driven into the workpiece;

a fastener-driving member cooperable with said drive track so as to drive the fastener that is to be driven out of said drive track and into the workpiece, said nose portion further having a fastener feed track that is located between said drive track and said magazine portion, said fastener feed track being configured to receive a succession of fasteners from said magazine portion and to guide the succession of fasteners toward and into said drive track;

an actuator that is actuated to cause said fastener-driving member to drive the headed fasteners into the workpiece; and fastener feed mechanism that advances the succession of fasteners along said fastener feed track to feed successive leading fasteners into said drive track; and wherein said feed mechanism further comprises an integrated function member having a check pawl portion and a last-fastener-retaining portion, said integrated function member being configured and operatively disposed relative to said fastener feed track and said fastener drive track such that 1) during operation of said fastener-driving tool in which two or more fasteners remain in the supply to be driven, said check pawl portion of said integrated function member engages the succession of fasteners within said fastener feed track to limit the succession of fasteners from moving away from said drive track as said feed mechanism retracts while operating to advance the succession of fasteners toward said drive track; and 2) such that when a last fastener remains to be driven into the workpiece, said last-fastener-retaining portion holds the last fastener within said drive track to prevent the last fastener from falling out of said drive track without being driven into the workpiece.

17. The fastener driving tool of claim 16 wherein said headed fasteners are headed nails each having a shank and a head on one end of said shank and being collated with the shanks in parallel relation to one another and retained in said parallel relation by flexible elongated structure fixed to the shanks thereof, said magazine portion being configured to retain a succession of collated and retained headed nails formed into a coil formation so as to allow a leading succession of the coil formation to be moved outwardly thereof and into the fastener feed track to be advanced therealong by said feed mechanism.

18. The fastener driving tool of claim 17 wherein said last fastener-retaining portion includes an arcuate head engaging surface disposed at a position disposed laterally with respect to the direction of movement of a last headed nail into said drive track, said arcuate surface being biased to move into engagement with a peripheral portion of the head of the last headed nail in said drive track and to grip the engaged head between said arcuate surface and a laterally spaced opposite arcuate surface of said drive track so that said last headed nail can be driven from said drive track while being gripped.

19. The fastener-driving tool of claim 18, wherein said nose portion further has a drive track access door mounted for movement between a closed operative position and an open access position enabling a user to manually load a new supply of fasteners into said magazine assembly.

20. The fastener-driving tool of claim 19, wherein said integrated function member is operatively connected to said drive track access door and is configured such that when said drive track access door is in the operative closed position thereof, said integrated function member is urged toward said fastener feed track.

21. The fastener-driving tool of claim 20, wherein said integrated function member is disposed within a recess formed on a feed-track-facing side of said drive track access door.

22. The fastener-driving tool of claim 20, wherein said integrated function member is generally lever-shaped and is pivotally mounted near an end thereof to said drive track access door.

23. The fastener-driving tool of claim 21, wherein said drive track access door has an arcuate portion which matches the shape of the arcuate surface disposed laterally opposite the arcuate surface of said last-fastener retaining portion which defines at least a portion of said drive track and wherein the arcuate shape of said last-fastener-retaining portion matches the arcuate shape of said arcuate portion of said drive track access door, whereby during the operation of said fastener-driving tool, the arcuate surface of said last-fastener-retaining portion cooperates with said arcuate surface of said drive track access door to define a portion of said drive track.

24. The fastener-driving tool of claim 18, wherein, said integrated function member has a bearing surface and is biased toward said fastener feed track such that during operation of the fastener-driving tool, the bearing surface bears against the shanks of said headed nails, which maintains said integrated function member in proper operative position for said operation of the fastener-driving tool, and wherein said check pawl portion comprises one or more check pawl shoulder portions, each check pawl shoulder portion having 1) a blocking surface that limits the succession of headed nails from moving away from said drive track as said feed mechanism retracts while operating to advance the succession of headed nails toward said drive track; and 2) a cam surface over which the shanks of the succession of headed nails move to push said integrated function member away from said feed track as said feed mechanism advances while operating to advance the succession of fastener members toward said drive track.

25. The fastener-driving tool of claim 24, wherein said nose portion further has a drive track access door by means of which said fastener feed track is accessed to manually load a new supply of fasteners into said nose portion and wherein said integrated function member is operatively connected to said drive track access door and is configured such that when said drive track access door is in a closed position for operation of said fastener-driving tool, said integrated function member is urged toward said fastener feed track of said nose portion so as to bias said check pawl shoulder portions toward said fastener feed track.

26. The fastener-driving tool of claim 16, wherein said fastener-driving tool is pneumatically actuated.

27. A fastener-driving tool for driving fasteners into a workpiece, said fastener-driving tool comprising:

a main body portion;

a magazine assembly including a magazine portion configured to receive therein a supply of fasteners to be driven into the workpiece;

a nose portion extending from said main body portion, said nose portion having a fastener drive track therein that is configured to receive a fastener to be driven into the workpiece;

a fastener-driving member cooperable with said drive track so as to drive the fastener that is to be driven out of said drive track and into the workpiece, said drive track having a workpiece-contacting end, said nose portion further having a fastener feed track that is located between said drive track and said magazine portion of said fastener-driving tool, said fastener feed track being configured to receive a succession of fasteners from said magazine portion and to guide the succession of fasteners toward and into said drive track;

an actuator that is actuated to cause said fastener-driving member to drive the fasteners into the workpiece; and fastener feed mechanism that advances the succession of fasteners along said fastener feed track to feed the fasteners into said drive track, said feed mechanism including an integrated function member having a check pawl portion and a dry fire lock-out portion, said integrated function member being configured and operatively disposed relative to said fastener feed track and said actuator such that 1) during operation of said fastener-driving tool in which approximately two or more fasteners remain in the supply to be driven, said check pawl portion of said integrated function member engages the succession of fasteners within said fastener feed track to limit the succession of fasteners from moving away from said drive track as said feed mechanism retracts while operating to advance the succession of fasteners toward said drive track; and 2) such that when no fasteners remain within said fastener-drive track, said dry fire lock-out portion prevents operation of said actuator, thereby preventing fastener-driving movement of said fastener-driving member.

28. The fastener-driving tool of claim 27, wherein said nose portion further has a drive track access door by means of which said fastener feed track is accessed to manually load a new supply of fasteners into said magazine assembly.

29. The fastener-driving tool of claim 28, wherein said integrated function member is operatively connected to said drive track access door and is configured such that when said drive track access door is in a closed position for operation of said fastener-driving tool, said integrated function member is urged toward said fastener feed track.

30. The fastener-driving tool of claim 28, wherein said integrated function member is disposed within a recess formed on a feed track-facing side of said drive track access door.

31. The fastener-driving tool of claim 30, wherein said integrated function member is generally lever-shaped and is pivotally mounted near an end thereof to said drive track access door.

32. The fastener-driving tool of claim 28, wherein said magazine portion includes a magazine cover member by means of which said magazine portion is accessed to load a supply of fasteners into said magazine portion, and wherein said drive track access door and said magazine cover member are cooperatively configured and arranged such that said drive track access door and said magazine cover member can be moved separately or together as a unit, whereby said fastener feed track and said magazine portion are opened and can be accessed simultaneously.

33. The fastener-driving tool of claim 27, wherein said integrated function member has a bearing surface and is biased toward said fastener feed track such that said bearing surface bears against the fasteners and wherein said check pawl portion comprises one or more cheek pawl shoulder portions, each check pawl shoulder portion having 1) a blocking surface that limits the succession of fasteners from moving away from said drive track as said feed mechanism retracts while operating to advance the succession of fasteners toward said drive track; and 2) a cam surface over which the succession of fasteners move to push said integrated function member away from said feed track as said feed mechanism advances while operating to advance the succession of fasteners toward said drive track.

34. The fastener-driving tool of claim 33, wherein said nose portion further has a drive track access door by means of which said fastener feed track is accessed to manually load a new supply of fasteners into said magazine assembly and wherein said integrated function member is operatively connected to said drive track access door and is configured such that when said drive track access door is in a closed position for operation of said fastener-driving tool, said integrated function member is urged toward said fastener feed track so as to bias said check pawl shoulder portions toward said fastener feed track.

35. The fastener-driving tool of claim 34, wherein said integrated function member is generally lever-shaped and is pivotally mounted near an end thereof to said drive track access door.

36. The fastener-driving tool of claim 27, wherein said dry fire lock-out portion prevents operation of said actuator by blocking movement of at least one component of said actuator.

37. The fastener-driving tool of claim 36, wherein said actuator comprises a trigger mechanism, a contact arm that is configured and disposed along said nose portion so as to move along said nose portion as a workpiece-contacting end of said drive track is moved toward a fastener-driving location on the workpiece, and a contact arm linkage mechanism operatively interconnecting said trigger mechanism with said contact arm, whereby said trigger mechanism cannot be operated to actuate said fastener-driving tool until the workpiece-contacting end of said drive track is within a predetermined or preselected distance from the fastener-driving location on the workpiece.

38. The fastener-driving tool of claim 37, wherein said integrated function member is configured and disposed relative to said actuator such that when no fasteners remain within said magazine assembly, said dry fire lock-out portion prevents operation of said actuator by blocking travel of said contact arm or said contact arm linkage mechanism.

39. The fastener-driving tool of claim 38, wherein said dry fire lock-out portion comprises a finger-shaped extension extending from a main body portion of said integrated function member.

40. The fastener-driving tool of claim 27, wherein said fasteners are headed nails in a coil formation and said fastener-driving tool is a roofing tool.

41. The fastener-driving tool of claim 40, wherein said fastener-driving tool is pneumatically actuated.

42. A fastener-driving tool for driving fasteners into a workpiece, said fastener-driving tool comprising:

a main body portion;

a magazine assembly having a magazine portion configured to receive therein a supply of fasteners to be driven into the workpiece;

a nose portion attached to said main body portion, said nose portion having a fastener drive hack therein that is configured to receive a headed fastener to be driven into the workpiece;

a fastener-driving member cooperable with said drive track so as to drive the fastener that is to be driven out of said drive track and into the workpiece, said nose portion further having a fastener feed track that is located between said drive track and said magazine portion of said fastener-driving tool, said fastener feed track being configured to receive a succession of fasteners from said magazine portion and to guide the succession of fasteners toward end into said drive track;

an actuator that is actuated to cause said fastener-driving member to drive the headed fasteners into the workpiece; and fastener feed mechanism that advances the succession of fasteners along said fastener feed track to feed the leading fastener of the succession of fasteners into said drive track;

wherein said feed mechanism comprises an integrated function member having a check pawl portion, a last-fastener-retaining portion, and a dry fire lock-out portion, said integrated function member being configured and operatively disposed relative to said fastener feed track and said drive track such that 1) during operation of said fastener driving tool in which approximately two or more fasteners remain in the supply to be driven, said check pawl portion of said integrated function member engages the succession of fasteners within said fastener feed track to limit the succession of fasteners from moving away from said drive track as said feed mechanism retracts while operating to advance the succession of fasteners toward said drive track; 2) such that when a last fastener remains to be driven into the workpiece, said last-fastener-retaining portion holds the last fastener within said drive track to prevent the last fastener from falling out of said drive track without being driven into the workpiece; and 3) such that when no fasteners remain within said fastener drive track, said dry fire lock-out portion prevents operation of said actuator, thereby preventing fastener-driving movement of said fastener-driving member.

43. The fastener driving tool of claim 42, wherein said headed fasteners are headed nails each having a shank and a head on one end of said shank and being collated with the shanks in parallel relation to one another and retained in said parallel relation by flexible elongated structure fixed to the shanks thereof said magazine portion being configured to retain a succession of collated and retained headed nails formed into a coil formation so as to allow a leading succession of the coil formation to be moved outwardly thereof and into the fastener feed track to be advanced therealong by said feed mechanism.

44. The fastener driving tool of claim 43, wherein said last fastener-retaining portion includes an arcuate head engaging surface disposed at a position disposed laterally with respect to the direction of movement of a last headed nail into said drive track, said arcuate surface being biased to move into engagement with a peripheral portion of the head of the last headed nail in said drive track and to grip the engaged head between said arcuate surface and a laterally spaced opposite arcuate surface of said drive track so that the last fastener can be driven out of the drive track while being gripped.

45. The fastener-driving tool of claim 44, wherein said drive track access door has an arcuate portion which matches the shape of the arcuate surface disposed laterally opposite the arcuate surface of said last-fastener retaining portion which defines at least a portion of said drive track and wherein the arcuate shape of said last-fastener-retaining portion matches the arcuate shape of said arcuate portion of said drive track access door, whereby during said operation of said fastener-driving tool, the arcuate surface of said last-fastener-retaining portion cooperates with said arcuate surface of said drive track access door to define a portion of said drive track.

46. The fastener-driving tool of claim 44, wherein said magazine portion includes a magazine cover member by means of which said magazine portion is accessed to load a supply of fasteners into said magazine portion, and wherein said drive track access door and said magazine cover member are cooperatively configured and arranged such that said drive track access door and said magazine cover member can be moved separately or together as a unit, whereby said fastener feed track and said magazine portion are opened and can be accessed simultaneously.

47. The fastener-driving tool of claim 46, wherein said nose portion further has a drive track access door by means of which said fastener feed track is accessed to manually load a new supply of fasteners into said magazine assembly and wherein said integrated function member is operatively connected to said drive track access door and is configured such that when said drive track access door is in a closed position for operation of said fastener-driving tool, said integrated function member is urged toward said fastener feed track so as to bias said check pawl shoulder portions toward said fastener feed track.

48. The fastener-driving tool of claim 47, wherein said integrated function member is generally lever-shaped and is pivotally mounted near an end thereof to said drive track access door.

49. The fastener-driving tool of claim 44, wherein said nose portion further has a drive track access door by means of which said fastener feed track is accessed to manually load a new supply of fasteners into said magazine assembly.

50. The fastener-driving tool of claim 49, wherein said integrated function member is operatively connected to said drive track access door and is configured such that when said drive track access door is in a closed position for operation of said fastener-driving tool, said integrated function member is urged toward said fastener feed track.

51. The fastener-driving tool of claim 50, wherein said integrated function member is disposed within a recess formed on a feed-track-facing side of said drive track access door.

52. The fastener-driving tool of claim 50, wherein said integrated function member is generally lever-shaped and is pivotally mounted near an end thereof to said drive track access door.

53. The fastener-driving tool of claim 43, wherein said integrated function member has a bearing surface and is biased toward said fastener feed track such that said bearing surface bears against the fasteners and wherein said check pawl portion comprises one or more check pawl shoulder portions, each check pawl shoulder portion having 1) a blocking surface that limits the succession of fasteners from moving away from said drive track as said feed mechanism retracts while operating to advance the succession of fasteners toward said drive track; and 2) a cam surface over which the succession of fasteners move to push said integrated function member away from said feed track as said feed mechanism advances while operating to advance the succession of fastener members toward said drive track.

54. The fastener-driving tool of claim 42, wherein said fastener-driving tool is pneumatically actuated.

* * * * *